US009687043B2

(12) United States Patent
Kenney

(10) Patent No.: US 9,687,043 B2
(45) Date of Patent: Jun. 27, 2017

(54) SHOE SOLE SIMULATING A HOOF

(71) Applicant: KENNEY SPORT, LLC, Upperville, VA (US)

(72) Inventor: Eileen Kenney, Upperville, VA (US)

(73) Assignee: KENNEY SPORT, LLC., Crozet, VA (US)

( * ) Notice: Subject to any disclaimer, the term of this patent is extended or adjusted under 35 U.S.C. 154(b) by 14 days.

(21) Appl. No.: 14/769,771

(22) PCT Filed: Feb. 21, 2014

(86) PCT No.: PCT/US2014/017741

§ 371 (c)(1),
(2) Date: Aug. 21, 2015

(87) PCT Pub. No.: WO2014/130835

PCT Pub. Date: Aug. 28, 2014

(65) Prior Publication Data

US 2016/0007679 A1 Jan. 14, 2016

Related U.S. Application Data

(60) Provisional application No. 61/767,882, filed on Feb. 22, 2013.

(51) Int. Cl.

| | |
|---|---|
| ***A43B 13/14*** | (2006.01) |
| ***A43B 3/00*** | (2006.01) |
| ***A43B 13/22*** | (2006.01) |
| ***A43B 13/12*** | (2006.01) |

(52) U.S. Cl.

CPC ..... *A43B 13/14* (2013.01); *A43B 3/0036* (2013.01); *A43B 3/0042* (2013.01); *A43B 3/0068* (2013.01); *A43B 13/122* (2013.01); *A43B 13/22* (2013.01); *A43B 13/223* (2013.01)

(58) Field of Classification Search

CPC ... A43B 3/0068; A43B 3/0042; A43B 3/0036; A01L 3/02; A01L 3/06; A01K 13/007

USPC ..... 36/111, 112, 59 R, 59 C; 119/850, 168; D30/146; D2/948, 951, 952, 954

See application file for complete search history.

(56) References Cited

U.S. PATENT DOCUMENTS

| | | | | |
|---|---|---|---|---|
| 31,286 A | | 2/1861 | Aiken | |
| 438,179 A | | 10/1890 | Quarrie | |
| 629,234 A | * | 7/1899 | Lander | A01L 7/02 168/26 |

(Continued)

FOREIGN PATENT DOCUMENTS

| | | |
|---|---|---|
| CA | 1 138 194 A | 12/1982 |
| CA | 2 227 108 A1 | 7/1998 |

(Continued)

*Primary Examiner* — Ted Kavanaugh

(74) *Attorney, Agent, or Firm* — Birch, Stewart, Kolasch & Birch, LLP

(57) ABSTRACT

A tread has a contour simulative of a horse hoof. A central recess is surrounded by a side wall forming the top and side edges of the tread. The side wall has in-turned ends that extend into the central recess. The in-turned ends taper in both height and width to their distal ends. A V-shaped protrusion is formed at a bottom of the tread and a curved surface transitions from the tread to the midsole. A tear drop shaped recess is formed in the V-shaped protrusion. The top of the V-shaped protrusion and top of the side wall are coplanar.

6 Claims, 5 Drawing Sheets

(56) References Cited

U.S. PATENT DOCUMENTS

| | | | | | |
|---|---|---|---|---|---|
| 642,286 | A | | 1/1900 | Berger | |
| 706,768 | A | * | 8/1902 | Marcley | A01L 7/02 168/28 |
| 2,041,538 | A | * | 5/1936 | Gash | A01L 5/00 168/1 |
| 2,754,598 | A | | 5/1954 | Aull | |
| 3,032,897 | A | | 5/1962 | Gelineau | |
| 3,236,310 | A | * | 2/1966 | Quick | A01L 3/02 168/18 |
| 3,402,485 | A | | 9/1968 | McMorrow | |
| 3,486,561 | A | * | 12/1969 | Kulak | A01L 7/02 168/4 |
| 3,494,055 | A | | 2/1970 | McSorley | |
| 3,538,628 | A | | 11/1970 | Einstein, Jr. | |
| 4,050,167 | A | | 9/1977 | Senter | |
| 4,050,168 | A | | 9/1977 | Pace | |
| 4,769,931 | A | * | 9/1988 | Morrow | A43B 13/26 36/134 |
| 4,958,446 | A | | 9/1990 | Brown | |
| D319,528 | S | * | 9/1991 | Letourneau | D2/912 |
| D323,059 | S | | 1/1992 | Hatfield | |
| 5,331,753 | A | | 7/1994 | Rodibaugh | |
| 5,465,507 | A | | 11/1995 | Schumacher et al. | |
| D378,108 | S | | 2/1997 | Shippy | |
| D381,795 | S | | 8/1997 | Coats | |
| 5,926,974 | A | * | 7/1999 | Friton | A43B 13/26 36/28 |
| 5,980,351 | A | | 11/1999 | McCook | |
| D418,663 | S | | 1/2000 | Senif | |
| 6,018,889 | A | | 2/2000 | Friton | |
| 6,080,033 | A | | 6/2000 | Fladwood et al. | |
| 6,226,896 | B1 | | 5/2001 | Friton | |
| D472,038 | S | | 3/2003 | Meynard | |
| 6,578,290 | B1 | | 6/2003 | Meynard | |
| D481,200 | S | | 10/2003 | Belley et al. | |
| 6,957,704 | B2 | | 10/2005 | Rogers et al. | |
| D525,017 | S | | 7/2006 | Ochoa | |
| D532,188 | S | | 11/2006 | McClaskie | |
| D603,108 | S | * | 10/2009 | Lander | D30/149 |
| D604,031 | S | | 11/2009 | Andersen et al. | |
| D627,545 | S | | 11/2010 | Raysse | |
| D629,573 | S | * | 12/2010 | Lander | D30/146 |
| D642,363 | S | | 8/2011 | Rajmohan et al. | |
| D655,077 | S | | 3/2012 | Prandini | |
| D659,363 | S | | 5/2012 | Leary et al. | |
| D659,961 | S | | 5/2012 | Vestuti et al. | |
| D659,962 | S | | 5/2012 | Vazquez | |
| D663,511 | S | | 7/2012 | Martinez et al. | |
| D663,931 | S | | 7/2012 | Allen et al. | |
| 2002/0195257 | A1 | | 12/2002 | Poynton | |
| 2003/0009914 | A1 | | 1/2003 | Mitsui et al. | |
| 2005/0072128 | A1 | * | 4/2005 | Ruetenik | A01K 13/007 54/82 |
| 2005/0097782 | A1 | | 5/2005 | Mills et al. | |
| 2005/0120589 | A1 | | 6/2005 | Coomes | |
| 2009/0031587 | A1 | | 2/2009 | Rusnak | |
| 2009/0249651 | A1 | | 10/2009 | Smith, Jr. | |
| 2010/0126045 | A1 | | 5/2010 | Rusnak | |
| 2011/0061268 | A1 | | 3/2011 | Park et al. | |
| 2014/0230283 | A1 | | 8/2014 | Cordova | |
| 2014/0230284 | A1 | | 8/2014 | Craig et al. | |

FOREIGN PATENT DOCUMENTS

| | | | |
|---|---|---|---|
| CN | 2618470 | Y | 6/2004 |
| DE | 937 996 | C | 1/1956 |
| EP | 0 919 150 | A2 | 6/1999 |
| EP | 0 811 330 | B1 | 10/2001 |
| EP | 1 266 586 | A1 | 12/2002 |
| WO | WO 2009/042296 | A1 | 4/2009 |

* cited by examiner

SHOE SOLE SIMULATING A HOOF

This application claims the benefit of provisional application 61/767,882, the contents of which are incorporated herein by reference in its entirety.

BACKGROUND OF THE INVENTION

Over time, evolution has allowed the hooves of animals to adapt to best suit the terrain encountered by the animal. For instance, animals living in mountains have hooves adept at gripping inclined surfaces. Moreover, the hooves will adapt to whether the inclined surface is rocky or soft. Similarly, animals living in dense forest or open plains have developed hooves providing the greatest advantage for the conditions encountered by the animals to increase the chances for long term survival. The sole for a shoe which simulates the hoof of an animal can realize the benefits of the hoof's contour, which provides benefits when the person wearing the shoe encounters terrain similar to the one normally encountered by the animal whose hoof is simulated.

Some shoes simulate an animal hoof. However, simulations often involve the upper shoe and are ornamental. In other words, the shoes are designed to provide the appearance that the lower part of the wearers leg is an animal leg. The shoes often involve boots which extend up towards the users make. These ornamental features do not provide any benefit to the user.

SUMMARY OF THE INVENTION

The sole of a shoe has a heel, a midsole and a tread portion extending from the mid-sole to the toe. The tread has a contour simulative of a horse hoof. A central recess is surrounded by a side wall forming the top and side edges of the tread. The side wall has in-turned ends that extend into the central recess. The in-turned ends taper in both height and width to their distal ends. A V-shaped protrusion is formed at a bottom of the tread and a curved surface transitions from the tread to the midsole. A tear drop recess is formed in the V-shaped protrusion. The top of the V-shaped protrusion and top of the side wall are coplanar. The tread provides traction on a variety of surfaces, including grassy fields, sand and hard surfaces, such as packed Earth or pavement.

DETAILED DESCRIPTION OF THE INVENTION

Figure 1:
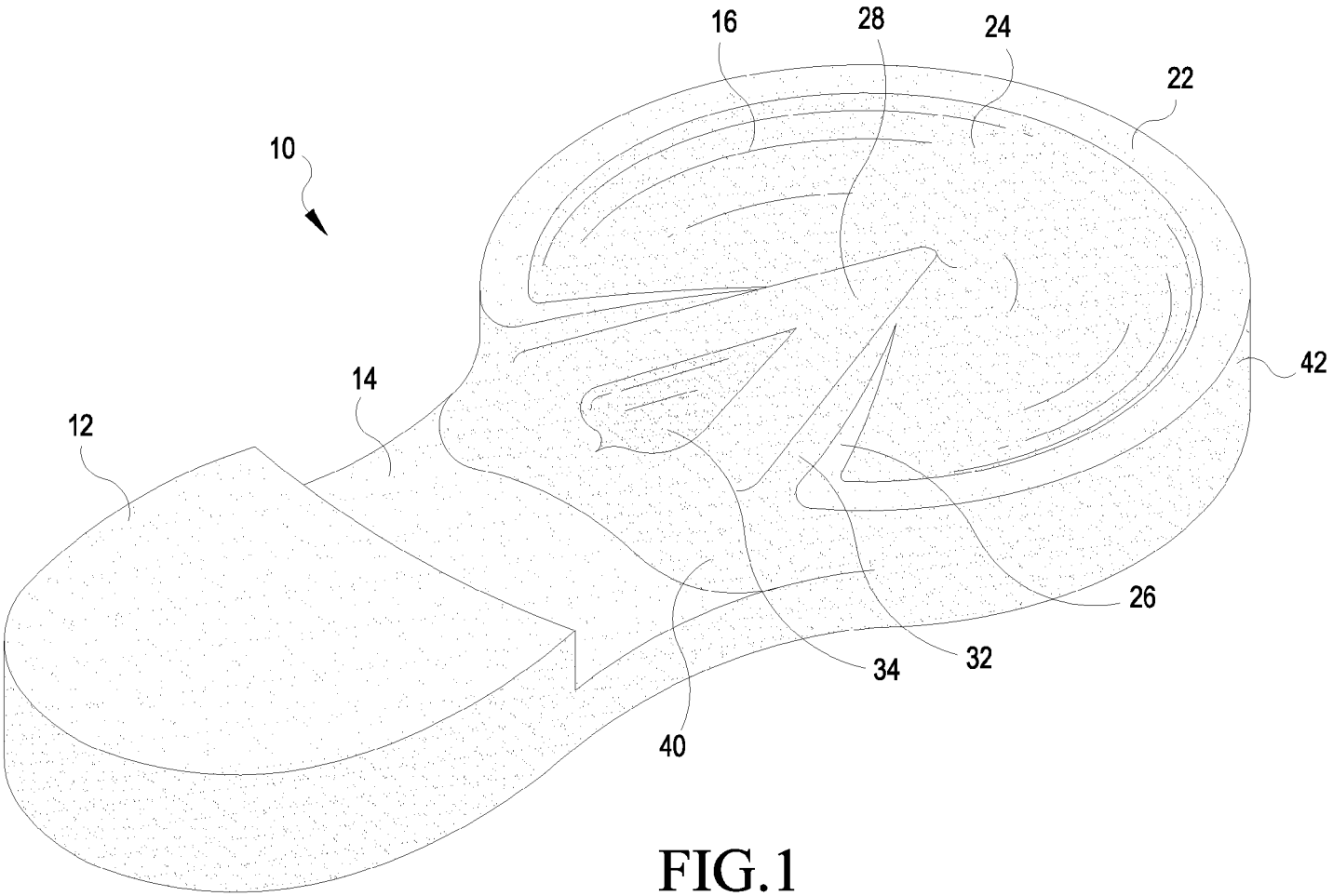
FIG. 1 is a top perspective view of the sole for shoe.

FIG. 1 depicts the sole 10 having a heel 12 and midsole 14. Located forward of the midsole 14 is the tread 16. The tread is formed by a side wall 22 extending around a periphery of the sole. The side wall surrounds a central recess 24. The ends of the side wall 22 have in-turned ends 26 extending diagonally into the central recess 24. The in-turned ends taper in both height and width to a distal end.

Located between the in-turned ends 26 is a V-shaped protrusion 28. A tear drop shaped recess 34 is formed within the V-shaped protrusion. The spaces between the V-shaped protrusion 28 and the in-turned ends 26 form channels 32. In an actual horse hoof, the V-shaped protrusion and recess are referred to as the "frog." The bottom of the tread borders the mid-sole and a rounded surface 40 extends to the midsole 14.

Figure 2:
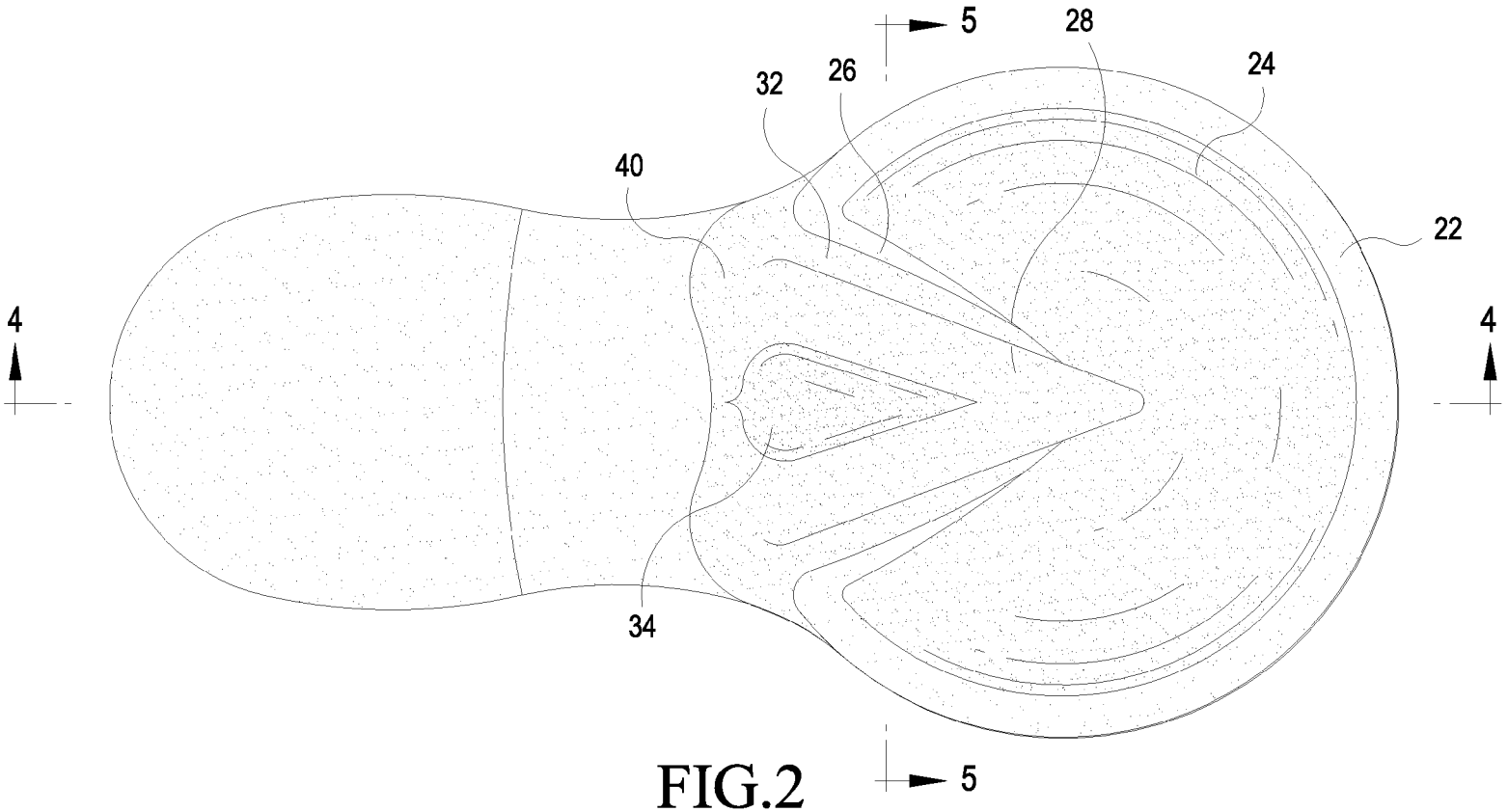
FIG. 2 is a top plan view thereof.

FIG. 2, a top view of the sole, clearly shows the heel 12, midsole 14 and tread 16. The side wall 22, central recess 24 and V-shaped protrusion 28 are all clearly seen, as is the channels 32 formed between the in-turned edges 26 of the side wall 22 and V-shaped protrusion 28. The tear drop shaped recess 34 and rounded bottom surface 40 are also seen.

Figure 3:
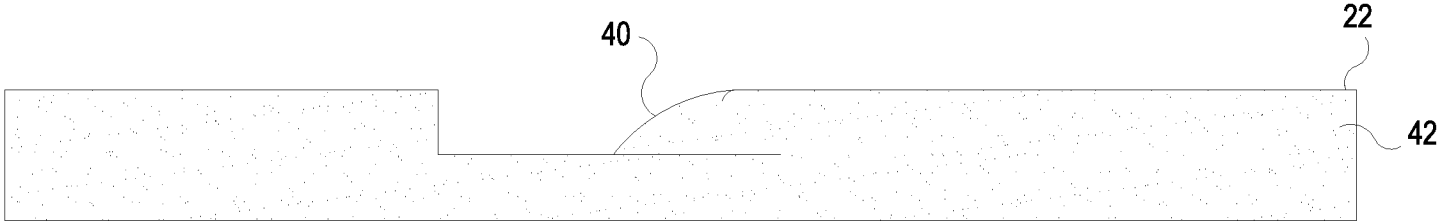
FIG. 3 is a right side view thereof, the left side view being a mirror image of the right side view.
Figure 4:
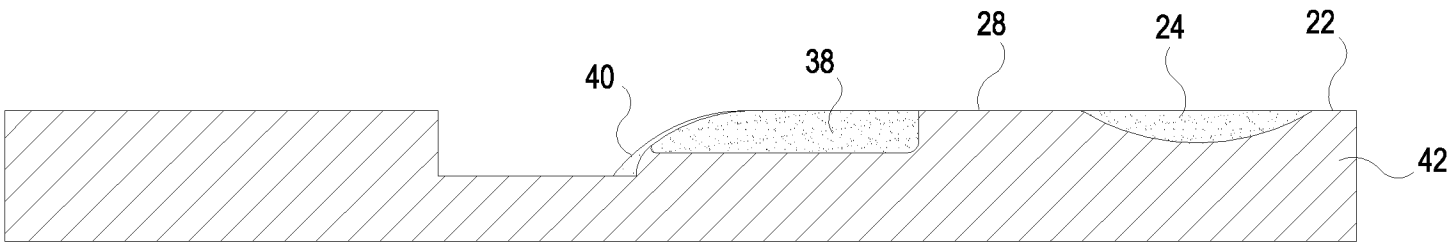
FIG. 4 is a cross-sectional view along line 4-4 of FIG. 2 through the centerline extending in the toe to heel direction.

FIG. 3 more clearly shows the tapered surface 40 extending upwardly from the midsole 14. In addition, a base 42 under the heel, midsole and tread is seen. The side wall 22 is formed by the top of the base 42. FIG. 4 is a cross-sectional view of the sole 10. As can be seen in FIGS. 3 and 4, the top surface of the side wall 22 and top surface of the V-shaped protrusion 28 are coplanar, creating a stable surface for contacting the ground. The bottom surface of the central recess is also seen in FIG. 4. The central recess is smooth, as the surface of the central recess is devoid of any protrusions or undulations. The central recess may be planar or slightly concave. The transition between the central recess and the side wall is rounded. The rounded transition provides lateral stability to the side wall and prevents the concentration of stresses at the inner bottom edge of the side wall where it meets the central recess. Similarly, the transition from the in-turned ends 26 and channels 34 are rounded to provide greater strength at this location. In addition, the tear drop shaped recess 38 is seen, as is the tapered surface 40.

Figure 5:
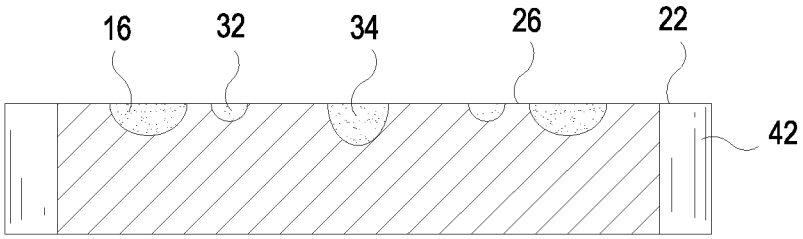
FIG. 5 is a cross-sectional view along line 5-5 of FIG. 2.

FIG. 5 is a cross section view across the width of the tread. The sectional view depicts the sides of the central recess 16, as well as the channels 32 and tear drop shaped recess 34. The relative depth of these recesses can be varied. As noted above, the bottom surfaces of the recesses and channels are smooth and can be flat or concave. Also seen is the side wall 22, in-turned ends 26 and V-shaped protrusion. The relationship between the in-turned ends 26 and V-shaped protrusion 28 to form the pair of channels 32 can easily be seen. The central recess, the tear drop shaped recess 34 and channels 32 contribute to provide enhanced traction in soft ground and in wet conditions. In addition, the top surfaces of the side wall 22, in-turned ends 26 and V-shaped protrusion are coplanar to provide a stable surface.

While the invention has been described with reference to a preferred embodiment, variations and modifications would be apparent to one of ordinary skill in the art. The invention encompasses such variations and modifications.

I claim:

1. A sole for a shoe, comprising:

a heel, a midsole and a tread, the tread comprising:

a central recess;

a side wall extending about the side of the sole and around the central recess, the side wall having ends extending inwardly from the edge of the sole into the central recess;

a V-shaped protrusion between the ends of the side wall; and a recess in the V-shaped protrusion.

2. The sole of claim 1, wherein the central recess is concave.

3. The sole of claim 1, wherein the recess in the V-shape protrusion is tear drop shaped.

4. The sole of claim 1, wherein the transition between the side wall and central recess is rounded.

5. The sole of claim 1, further comprising a bottom surface bordering the midsole, wherein the bottom surface is rounded.

6. The sole of claim 1, wherein the inwardly extending ends of the side wall taper in width and height as the ends extend from the side wall.

* * * * *